US010119307B2

(12) United States Patent
Sugimoto

(10) Patent No.: US 10,119,307 B2
(45) Date of Patent: Nov. 6, 2018

(54) VEHICLE HANDLE DEVICE

(71) Applicant: ALPHA CORPORATION, Yokohama-shi, Kanagawa (JP)

(72) Inventor: Koichiro Sugimoto, Yokohama (JP)

(73) Assignee: ALPHA CORPORATION, Yokohama-shi, Kanagawa (JP)

( * ) Notice: Subject to any disclaimer, the term of this patent is extended or adjusted under 35 U.S.C. 154(b) by 93 days.

(21) Appl. No.: 15/296,119

(22) Filed: Oct. 18, 2016

(65) Prior Publication Data

US 2017/0037663 A1 Feb. 9, 2017

Related U.S. Application Data

(63) Continuation of application No. PCT/JP2015/062309, filed on Apr. 22, 2015.

(30) Foreign Application Priority Data

Apr. 22, 2014 (JP) ..... 2014-088281

(51) Int. Cl.
*E05B 3/00* (2006.01)
*E05B 79/22* (2014.01)
(Continued)

(52) U.S. Cl.
CPC ..... *E05B 79/22* (2013.01); *E05B 79/06* (2013.01); *E05B 79/08* (2013.01); *E05B 79/20* (2013.01)

(58) Field of Classification Search
CPC ..... E05C 79/00; E05C 79/06; E05C 79/10; E05C 79/20; E05C 79/22; E05C 79/08; E05C 85/10; E05C 85/12; E05C 85/13; E05C 85/14; E05C 85/16; E05B 79/00; E05B 79/06; E05B 79/10; E05B 79/20;
(Continued)

(56) References Cited

U.S. PATENT DOCUMENTS 5,884,434 A * 3/1999 Dedrich ..... E05B 85/12 296/146.7
2007/0289222 A1* 12/2007 Papi ..... E05B 79/06 49/502
(Continued)

FOREIGN PATENT DOCUMENTS

CN A-101311483 11/2008
FR A1-2876077 4/2006
(Continued)

OTHER PUBLICATIONS

Extended European Search Report dated Oct. 30, 2017 in corresponding European patent application 15783041.5 (6 pages).
(Continued)

*Primary Examiner* — Alyson M Merlino
(74) *Attorney, Agent, or Firm* — Drinker Biddle & Reath LLP

(57) ABSTRACT

A vehicle handle device includes a handle base, an operation portion that is rotatably connected to the handle base, a cable device that includes an outer cable and an inner cable inserted into the outer cable and transmits operating force to a door lock device of a vehicle, a cable connection unit mounted to a tip end of the outer cable, a unit case that is provided in the cable connection unit, and a cam portion that is provided in the unit case.

5 Claims, 7 Drawing Sheets

(51) Int. Cl.
*E05B 79/06* (2014.01)
*E05B 79/08* (2014.01)
*E05B 79/20* (2014.01)

(58) Field of Classification Search
CPC ..... E05B 79/22; E05B 79/08; E05B 85/10; E05B 85/12; E05B 85/13; E05B 85/14; E05B 85/16; Y10T 292/57
See application file for complete search history.

(56) References Cited

U.S. PATENT DOCUMENTS

| | | | | |
|---|---|---|---|---|
| 2008/0290671 | A1 | 11/2008 | Kagawa et al. | |
| 2011/0308172 | A1 | 12/2011 | Schidan et al. | |
| 2013/0168979 | A1 | 7/2013 | Minemura | |
| 2016/0076275 | A1* | 3/2016 | Uemura ..... | E05B 85/13 292/336.3 |

FOREIGN PATENT DOCUMENTS

| | | | |
|---|---|---|---|
| JP | 2011-099238 | A | 5/2011 |
| JP | 2012-097476 | A | 5/2012 |
| WO | WO-A2-2009-015903 | | 2/2009 |

OTHER PUBLICATIONS

CN Office Action dated Mar. 21, 2018 in Chinese Application No. 201580021017.8 with English language translation.

* cited by examiner

VEHICLE HANDLE DEVICE

CROSS REFERENCE TO RELATED APPLICATIONS

This application is a continuation of PCT application No. PCT/JP2015/062309, which was filed on Apr. 22, 2015 based on Japanese Patent Application (No. 2014-088281) filed on Apr. 22, 2014, the contents of which are incorporated herein by reference.

BACKGROUND OF THE INVENTION

Field of the Invention

This disclosure relates to a vehicle handle device.

Description of Related Art

Patent Literature 1(:JP-A-2012-097476) discloses a vehicle handle device which is mounted to a door of a vehicle.

In the handle device disclosed in Patent Literature 1, a lock knob and an inner door handle are rotatably connected to a handle base. A tip end of an inner cable of a cable device is locked to an engaging portion formed in each operation portion. Rotation operating force applied to the operation portion is transmitted to a latch and lock unit via the inner cable.

In the handle device disclosed in Patent Literature 1, the inner cable is required to be engaged with the engaging portion such that the falling out of the inner cable from the engaging portion can be prevented during the operation of the operation portion. For this reason, there is a problem in that operability when the inner cable is to be engaged with the engaging portion deteriorates, and assemblability deteriorates.

[Patent Literature 1] JP-A-2012-097476

SUMMARY

One or more embodiments provide a handle device facilitating improved operability when connecting a cable device.

BRIEF DESCRIPTION OF THE DRAWINGS

FIG. 4A illustrates a base case. FIG. 4B is a sectional view taken along line 4B-4B in FIG. 4A illustrating a step of connecting a case cover.

FIG. 7A is a sectional view illustrating a state in which a cam portion is in contact with a driven projection portion. FIG. 7B is a partial cutaway sectional view illustrating a state in which a lock knob is rotated by the cam portion.

FIG. 8A is a sectional view illustrating a complete connection state. FIG. 8B is a sectional view illustrating a state in which the lock knob is operated to an unlock position.

DETAILED DESCRIPTION

Hereinafter, an embodiment will be described with reference to the accompanying drawings. The accompanying drawings and the following disclosure are examples of this disclosure, and do not intend to limit the concept of the claims.

Figure 1A:
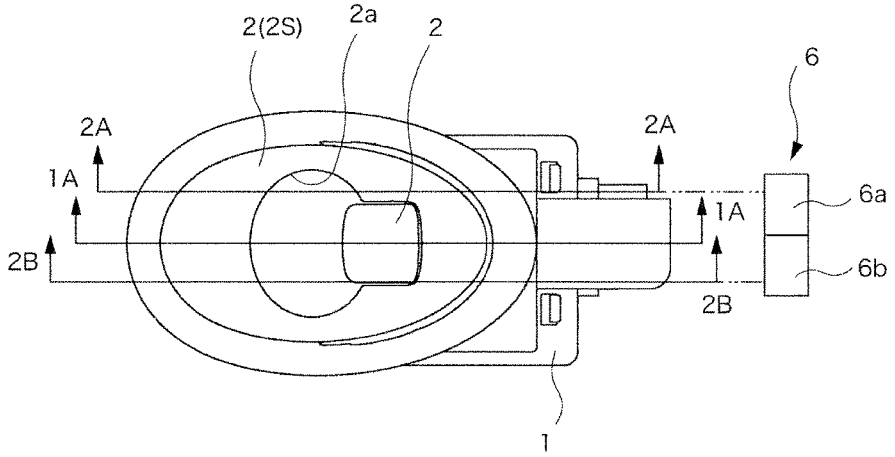
FIG. 1A is a front view of an inside handle device.

FIG. 1A and the following drawings illustrate an embodiment of this disclosure relating to a door inside handle device of a vehicle. The inside handle device is formed such that a temporary hold operation portion 2S as an operation handle and an operation portion 2 as a lock knob are coaxially and rotatably connected to a handle base 1 fixed to a door panel of the vehicle.

As illustrated in FIG. 1A, the operation handle 2S has an elliptical shape in a plan view in which a central portion of the operation handle 2S is open. The lock knob 2 is disposed in a recessed portion formed by cutting out an edge of a central opening portion 2*a* of the operation handle 2S.

Figure 1B:
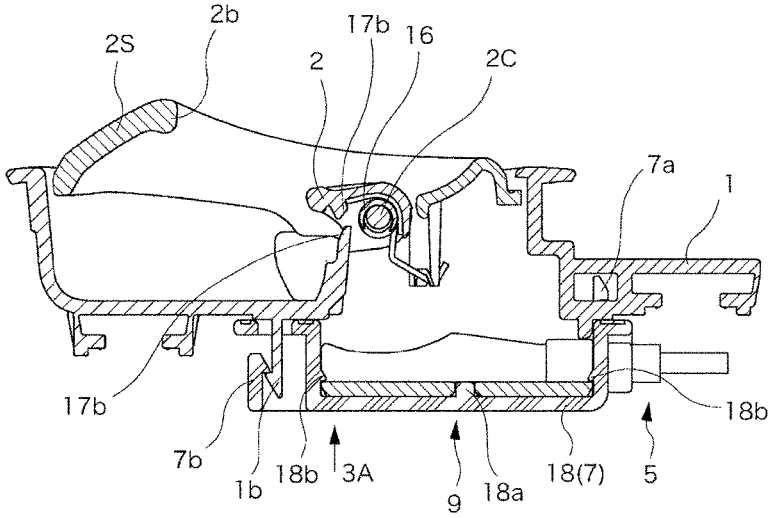
FIG. 1B is a sectional view taken along line 1A-1A in FIG. 1A.
Figure 2A:
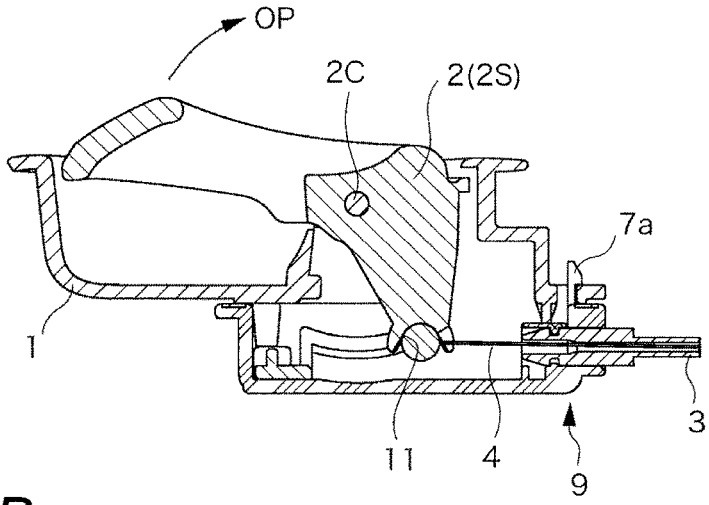
FIG. 2A is a sectional view taken along line 2A-2A in FIG. 1A.
Figure 2B:
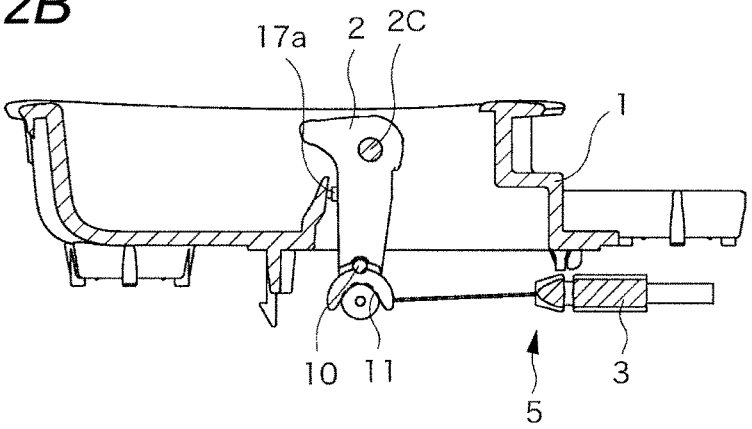
FIG. 2B is a sectional view taken along line 2B-2B in FIG. 1A.

As illustrated in FIG. 1B, the operation handle 2S is temporarily held at an initial rotational position illustrated in FIGS. 1B and 2B by being biased by a torsion spring 16 wrapped around a rotational shaft (2C). An operator can rotate the operation handle 2S to an operational rotational position by hooking a fingertip, which is input through the central opening portion 2*a*, to a finger hook edge 2*b*, and pulling up the operation handle 2S in the direction of an arrow (OP) illustrated in FIG. 2A. Rotation operating force applied to the operation handle 2S is transmitted, via a cable device 5, to a door lock device 6 fixed inside the door, and operates a latch portion 6*a* of the door lock device 6.

Figure 2C:
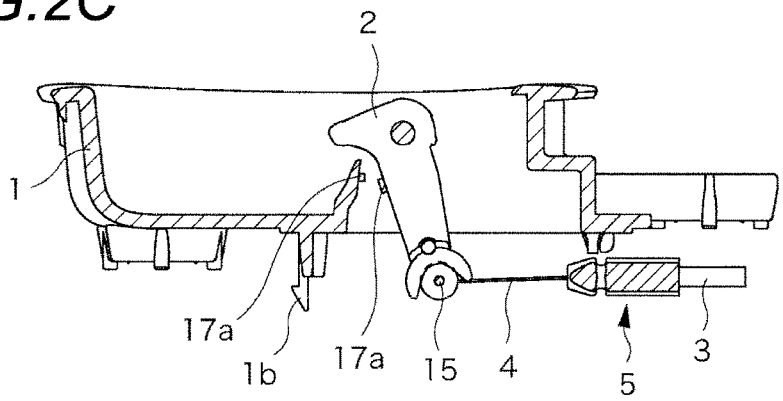
FIG. 2C is a sectional view taken along line 2B-2B illustrating an unlocked state.

The lock knob 2 is mounted around the rotational shaft without the biasing force of the torsion spring 16 applied to the lock knob 2. The lock knob 2 is operated to rotate between a lock position illustrated in FIGS. 1B and 2B and an unlock position illustrated in FIG. 2C. A lock stopper 17*a* (refer to FIG. 2B) for restricting the lock position and an unlock stopper 17*b* (refer to FIG. 1B) for restricting the unlock position are provided in the lock knob 2 and the handle base 1.

The lock knob 2 is connected to a lock portion 6*b* of the door lock device 6 via the cable device 5. If the lock knob 2 is rotated from the unlock position to the lock position, an input from the operation handle 2S to the latch portion 6*a* is restricted, and a release operation of the latch portion 6*a* performed by the operation handle 2S is prohibited.

Figure 4A:
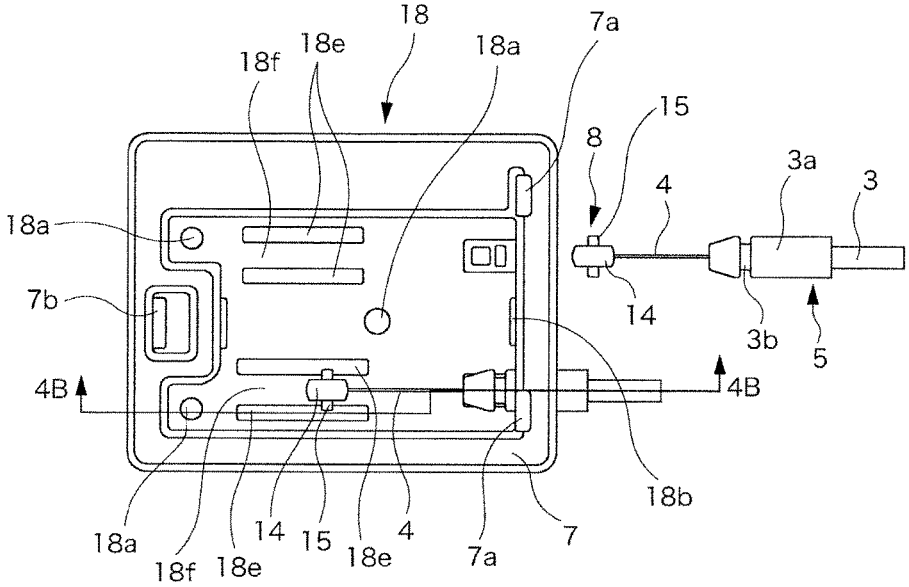
FIGS. 4A and 4B illustrate the cable connection unit.
Figure 4B:
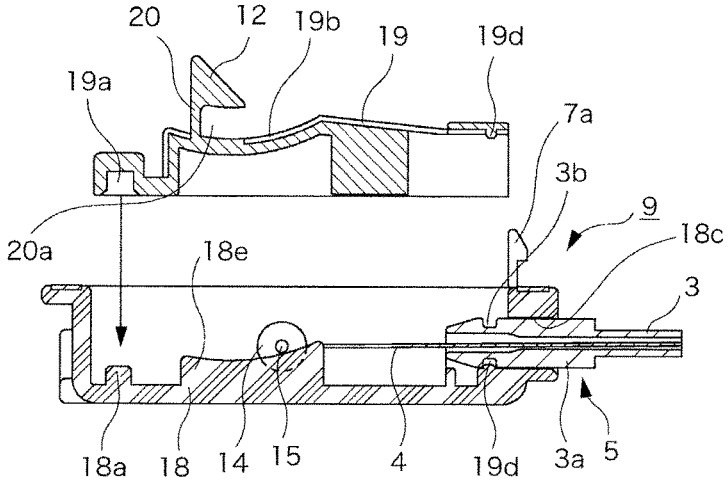

As illustrated in FIGS. 4A and 4B, the cable device 5 is formed such that an inner cable 4 is movably inserted into an outer cable 3. A fixed side connection portion 3*a* is formed at a tip end of the outer cable 3 of the cable device 5. A handle connection portion 8 is formed at a tip end of the inner cable 4, and pin-shaped projections 15 respectively project from both side surfaces of a wheel-shaped connection main body portion 14 of the handle connection portion 8.

A cable connection unit 9 is connected to a tip end of the cable device 5 having the aforementioned configuration which is connected to the operation handle 2S and the lock knob 2. The cable connection unit 9 holds the handle connection portion 8 of the inner cable 4 inside a unit case 7.

Figure 5:
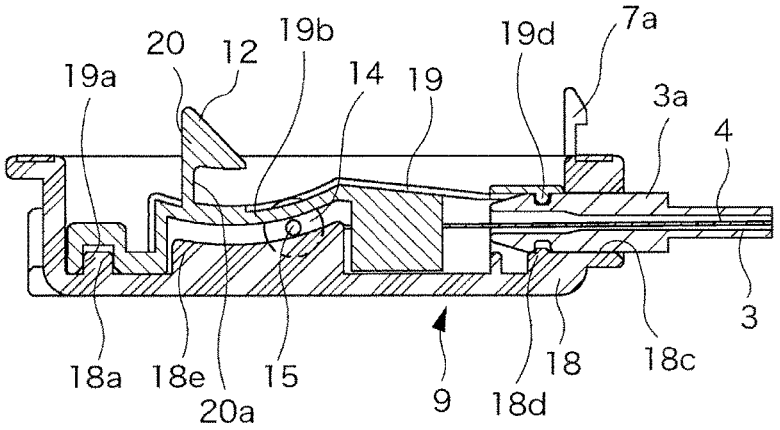
FIG. 5 is a sectional view taken along line 4B-4B in FIG. 4A illustrating the complete cable connection unit.

As illustrated in FIGS. 4A to 5, the unit case 7 is formed such that a case cover 19 is connected to a base case 18. The base case 18 is connected to the case cover 19 by respectively fitting positioning bosses 18*a*, which project from the base case 18, into fitting holes 19*a* of the case cover 19, and by locking a locking claw 18*b*, which projects from the base case 18, to the case cover 19 (refer to FIG. 1B).

The cable device 5 is mounted to the unit case 7 by inserting and fixing the outer cable 3 of the cable device 5 to a cable insertion opening 18*c* provided in the base case 18. As illustrated in FIG. 4B, a retaining slit 3*b* is formed in the fixed side connection portion 3*a* of the outer cable 3. The cable device 5 inserted into the base case 18 is retained by locking retaining projections 18*d* and 19*d*, which are respectively formed in both the base case 18 and the case cover 19, to the retaining slit 3*b*.

The pin-shaped projections 15 of the handle connection portion 8 are supported to be movable along a predetermined trajectory, and thus the inner cable 4 of the cable device 5 introduced into the unit case 7 is held. The base case 18 includes a pair of pin support portions 18*e* which is provided along a main body portion movement path 18*f*, on which the connection main body portion 14 of the handle connection portion 8 is moved, so as to support the pin-shaped projections 15. The pin-shaped projections 15 supported on the pin support portions 18*e* are covered with a pin cover portion 19*b* of the case cover 19 that is disposed with a constant gap between the pin cover portion 19*b* and the pin support portions 18*e*, and the deviation of the pin-shaped projections 15 from the pin support portion 18*e* is restricted.

A portion of the case cover 19, which directly faces the main body portion movement path 18*f* of the base case 18, is open. In a state where the case cover 19 is mounted to the base case 18, the connection main body portion 14 is exposed to a surface of the case cover 19.

Each of the pin support portions 18*e* is formed as an arc surface. In a state where the unit case 7 is connected to the handle base 1, the center of the arc is determined to coincide with a rotational center (2C) of the operation handle 2S and the lock knob 2. The radius of curvature is determined such that a movement trajectory of the connection main body portion 14 coincides with the center of a cable connection portion 11 (to be described later) of the operation handle 2S and the lock knob 2.

Figure 3:
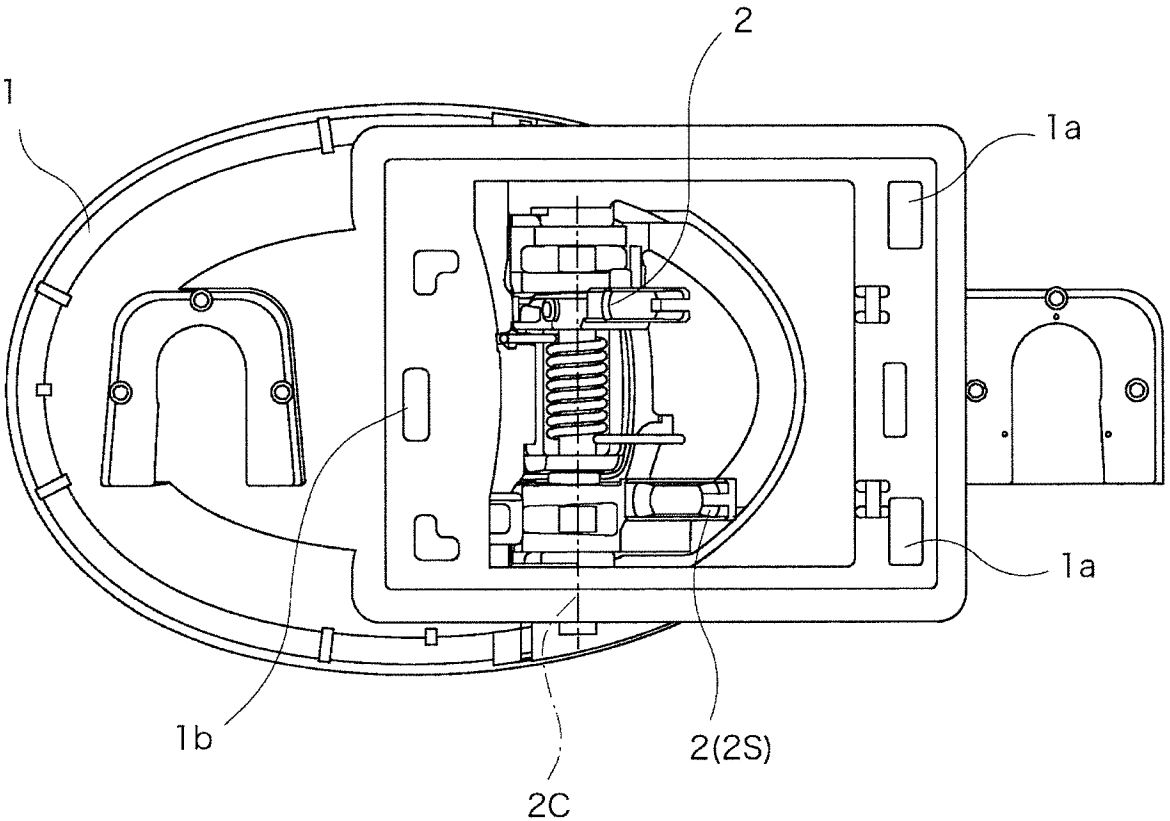
FIG. 3 is a perspective view in the direction of an arrow 3A in FIG. 1B illustrating a state before a cable connection unit is connected.

The cable connection unit 9 having the aforementioned configuration is connected to the handle base 1 by elastically locking an elastic locking leg 7*a*, which projects from the unit case 7, to a locked portion 1*a* (refer to FIG. 3) of the handle base 1, and as illustrated in FIG. 1B, by elastically locking an elastic locking leg 1*b*, which projects from the handle base 1, to a locked portion 7*b* of the unit case 7.

The elastic locking leg 7*a* and the locked portion 7*b* of the unit case 7 are formed in the base case 18. In a state where the unit case 7 is connected to the handle base 1, the case cover 19 is interposed between the base case 18 and the handle base 1, and thus the separation of the unit case 7 from the handle base 1 is prevented.

Figure 6:
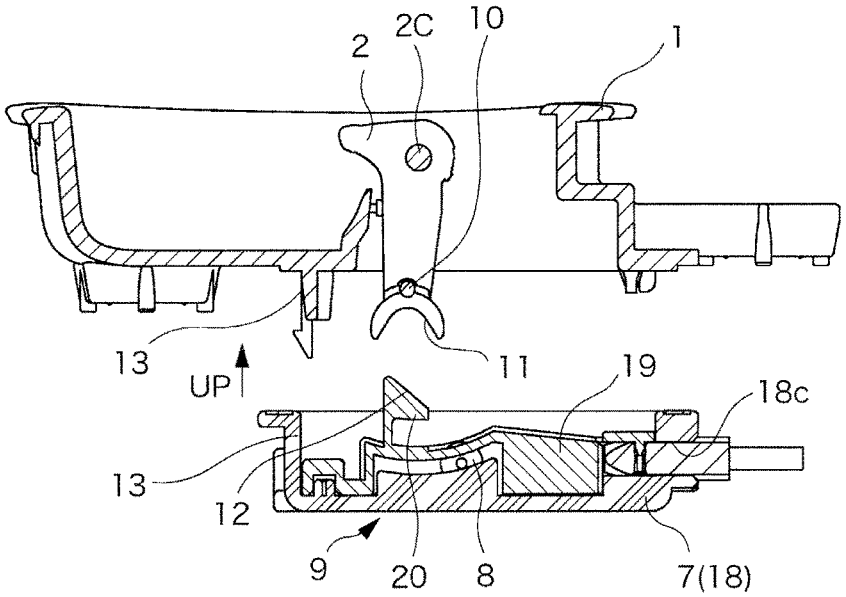
FIG. 6 is a sectional view illustrating an operation of connecting the cable connection unit to a handle base.

As illustrated in FIG. 6, the cable connection unit 9 is connected to the handle base 1 by moving the cable connection unit 9 along guides 13, which are respectively provided in the handle base 1 and the unit case 7, in a direction perpendicular to an attachment direction of the cable device 5 with respect to the cable connection unit 9. The handle connection portion 8 inside the cable connection unit 9 is connected to the cable connection portion 11 of the operation handle 2S and the lock knob 2 during an operation of connecting the cable connection unit 9 to the handle base 1.

The cable connection portion 11 is connected to the handle connection portion 8 by fitting the connection main body portion 14 of the handle connection portion 8 to the cable connection portion 11. The handle connection portion 8 is formed into a cutout shape which opens in an advancing direction of the cable connection unit 9. An innermost portion of the handle connection portion 8 is formed to have substantially the same diameter dimension as that of the connection main body portion 14. The width of the handle connection portion 8 is gradually widened toward an opening end such that even if the connection main body portion 14 has deviated from a predetermined fit position, the connection main body portion 14 can be brought thereinto.

When the handle connection portion 8 is to be connected to the cable connection portion 11, first, the handle connection portion 8 of the cable device 5 is held at a substantially constant position by the state of the door lock device 6 in a state where the other end of the handle connection portion 8 is connected to the door lock device 6.

FIG. 6 illustrates the corresponding position of the handle connection portion 8 connected to the lock knob 2 when the lock portion 6*b* of the door lock device 6 is at the lock position. At this time, the handle connection portion 8 connected to the operation handle 2S is held at anon-operative position corresponding to a non-operative state of the latch portion 6*a*, which is not illustrated, and the position is positioned directly below the cable connection portion 11 of the operation handle 2S at the initial rotational position, to be exact, is positioned on amounting trajectory of the cable connection unit 9 with respect to the handle base 1.

A cam projection portion 20 and a driven projection portion 10 are respectively provided in the cable connection unit 9 and the lock knob 2. As illustrated in FIG. 6, the driven projection portion 10 projects in the vicinity of (in this example, directly above the cable connection portion 11) the cable connection portion 11 of the lock knob 2.

The cam projection portion 20 projects from the case cover 19 of the unit case 7 toward the driven projection portion 10, and a cam portion 12 is formed at an upper end of the cam projection portion 20. The cam portion 12 is formed as an inclined surface such that when the unit case 7 is moved along the guide 13 on a connection path of the unit case 7 with respect to the handle base 1, the cam portion 12 pushes the driven projection portion 10, and rotates the lock knob 2 to the lock position, or to a rotational end edge position corresponding to the unlock position.

In the embodiment in which in a state where the cable device 5 is connected to the door lock device 6, the handle connection portion 8 corresponding to the lock knob 2 is positioned substantially at the unlock position, the direction of the inclined surface of the cam portion 12 is set such that the cable connection portion 11 of the lock knob 2 is moved to the unlock position. As illustrated in FIGS. 6 and 7(*a*), the range of the inclined surface in a width direction, that is, in a direction perpendicular to the mounting trajectory of the cable connection unit 9 is set such that even if the lock knob 2 is present at the lock position, the cam portion 12 is capable of coming into contact with the driven projection portion 10, and rotating the lock knob 2 up to a position (refer to FIG. 7B) at which an open tip end of the cable connection portion 11 is capable of catching the connection main body portion 14.

Figure 7A:
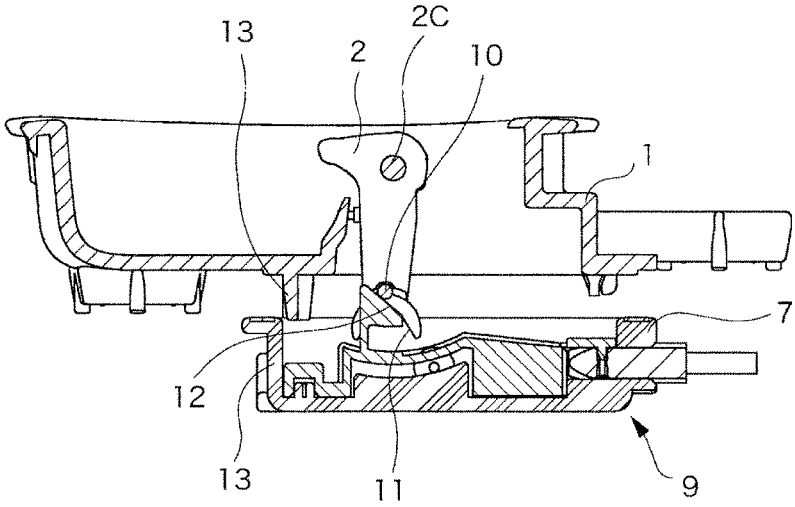
FIGS. 7A and 7B illustrate the operation of connecting the cable connection unit to the handle base.
Figure 7B:
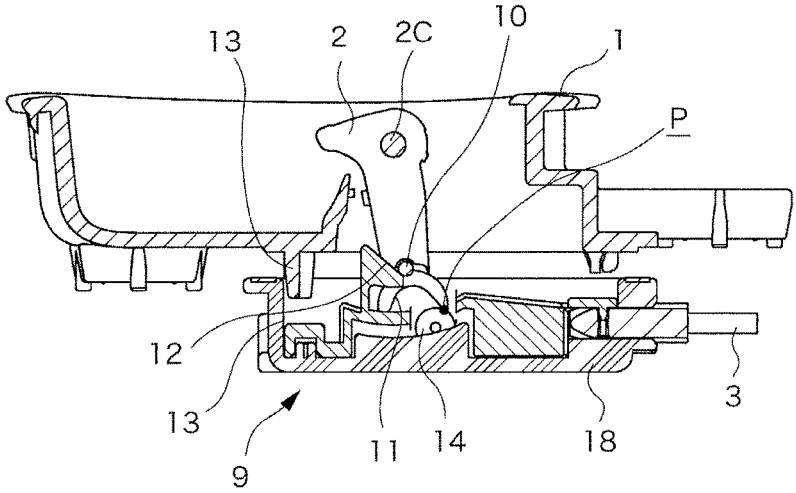
Figure 8A:
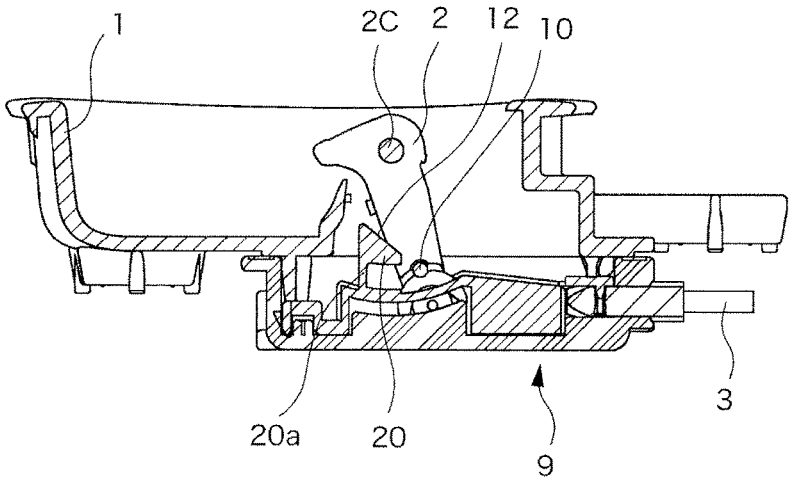
FIGS. 8A and 8B illustrate the operation of connecting the cable connection unit to the handle base.

In this example, if the cable connection unit 9 is moved upward (in the direction of an arrow UP) in a non-connection state illustrated in FIG. 6, as illustrated in FIG. 7A, the cam portion 12 comes into contact with the driven projection portion 10 of the lock knob 2, and if the cable connection unit 9 is further pushed upward along the guide 13, as illustrated in FIG. 7B, the lock knob 2 is rotated. Since a contact point (P) between the open tip end of the cable connection portion 11 and the connection main body portion 14 exceeds the center of the connection main body portion 14 while the driven projection portion 10 is moved up to the position of an end edge of the cam portion 12, if the cable connection unit 9 is further moved upward, as illustrated in FIG. 8A, the lock knob 2 is rotated up to a locking position in a state where the lock knob 2 is picked up by the connection main body portion 14.

As described above, since at a complete locking position, a circumferential edge of the connection main body portion 14 is in contact with an innermost portion inner circumferential wall of the cable connection portion 11, and the connection main body portion 14 is moved along a trajectory of the cable connection portion 11 in a state where the unit case 7 is connected to the handle base 1, the state of contact is maintained, and a synchronous operation between both the connection main body portion 14 and the cable connection portion 11 is ensured.

Since the cable connection portion 11 of the operation handle 2S which is guaranteed to be held at the initial rotational position by the torsion spring 16, and the connection main body portion 14, which is held at the non-operative position by being connected to the door lock device 6, are aligned on the mounting trajectory of the cable connection unit 9, the cable connection portion 11 is connected to the connection main body portion 14 when the cable connection unit 9 is mounted to the handle base 1.

Figure 8B:
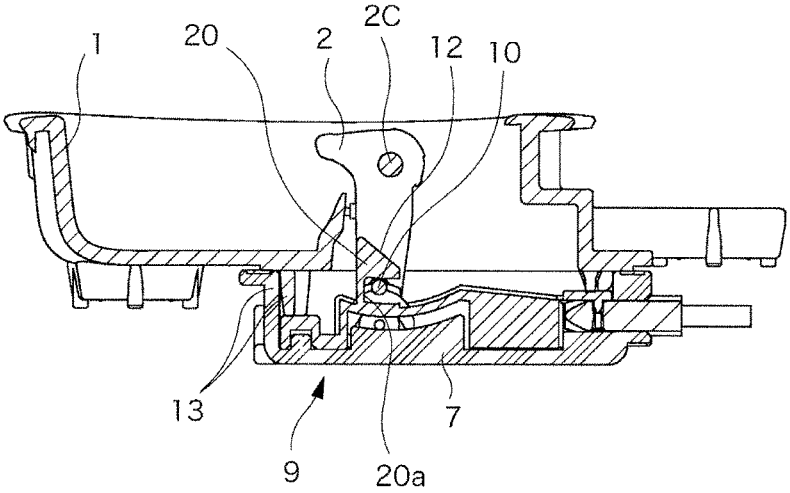

As illustrated in FIG. 8B, since the cam projection portion 20 is provided with a cutout 20*a* through which the driven projection portion 10 of the lock knob 2 is allowed to pass, the driven projection portion 10 does not interfere with the cam projection portion, and thus the movement of the lock knob 2 to the lock position is not obstructed.

In the description of the present invention, an inside handle device including one lock knob 2 and one operation handle 2S has been exemplified. Alternatively, a handle device may be also configured to include multiple operation portions 2.

In the embodiment, the vehicle handle device is formed such that the operation portion 2 is rotatably connected to the handle base 1. An operating force applied to the operation portion 2 is transmitted to the door lock device 6 of the vehicle via the cable device 5 in which the inner cable 4 is inserted into the outer cable 3, and remotely operates the door lock device 6.

The cable connection unit 9 is mounted to the tip end of the outer cable 3 of the cable device 5. In the cable connection unit 9, the handle connection portion 8 formed in the inner cable 4 is held by the unit case 7 connectable to the handle base 1 such that the handle connection portion 8 can be moved on a predetermined movement path.

The unit case 7 of the cable connection unit 9 is provided with the cam portion 12 that presses the driven projection portion 10 provided in the operation portion 2 and moves the cable connection portion 11 of the operation portion 2 to a connecting position of the cable connection portion 11 with respect to the handle connection portion 8 during an operation of mounting the cable connection unit 9 to the handle base 1.

The cable device 5 is formed such that the inner cable 4, at the tip end of which the handle connection portion 8 is formed, is slidably inserted into the outer cable 3. A movement trajectory of the handle connection portion 8 is restricted by the unit case 7 of the cable connection unit 9 mounted to the tip end of the outer cable 3, and the handle connection portion 8 is movably held.

In the embodiment, since the movement trajectory of the handle connection portion 8 is restricted by the unit case 7, it is not necessary to directly operate the handle connection portion 8, the position of which is not fixed due to being formed at the tip end of the flexible inner cable 4, and to guide the handle connection portion 8 to the handle connection portion 11 of the operation portion 2, and it is possible to mount the cable device 5 to the operation portion 2 by only connecting the cable connection unit 9 to the handle base 1 of the handle device. As a result, operability in the connection of the cable improves.

During an operation of mounting the cable connection unit 9 to the handle base 1, the cam portion 12 is capable of pushing the driven projection portion 10 of the operation portion 2, moving the operation portion 2, that is, the cable connection portion 11 to a position at which the cable connection portion 11 can be connected to the cable device 5, and holding the cable connection portion 11. For this reason, during the mounting of the cable connection unit 9, there is no need for an operator to hold the operation portion 2 with a hand at the position at which the operation portion 2 can be connected to the cable device 5. As a result, operability in the connection of the cable improves.

A mounting path of the unit case 7 may be restricted by the guide 13 formed in the handle base 1.

An operator can freely set a mounting path of the cable connection unit 9 such that the driven projection portion 10 can be picked by the cam portion 12 during a mounting operation. It is possible to easily perform an operation by providing the guide 13 in the handle base 1, and to reliably prevent an erroneous operation in which the cable connection unit 9 is assembled to the handle base 1 without the driven projection portion 10 being picked up.

The pin-shaped projections 15, which project from both ends of the connection main body portion 14 having a circular section, may be movably supported, and thus, the handle connection portion 8 may be held on the movement trajectory in a state where the cable connection unit 9 is mounted to the handle base 1. The cable connection portion 11 may be able to be locked to the connection main body portion 14 in an outer circumferential direction, the diameter dimension of the innermost portion substantially coincides with that of the connection main body portion 14, and the cable connection portion 11 may be formed into a cutout shape in which the width of the cable connection portion 11 is gradually widened toward an open end.

The cable connection portion 11 of the operation portion 2 is formed into a cutout shape in which the cable connection portion 11 is widened toward an end. The width dimension of the open end of the cutout is set to a value which is considerably larger than the diameter of the connection main body portion 14 of the handle connection portion 8. As a result, even if there is the occurrence of a variation in the movement of the operation portion 2 by the cam portion 12, the operation portion 2 can be reliably fitted to the cable connection portion 11.

Since the connection main portion 14 is held on the movement trajectory in a state where the cable connection unit 9 is mounted to the handle base 1, the state of contact between the connection main body portion 14 and the innermost portion of the cable connection portion 11, that is, a portion of the cable connection portion 11 which has the same diameter as that of the connection main body portion 14 is maintained in a state where the cable connection unit 9 is mounted to the handle base 1. For this reason, wobbling between the cable connection portion 11 and the connection main body portion 14 in a movement direction of the operation portion 2 does not occur. As a result, a stroke loss does not occur.

In the vehicle handle device of the embodiment, the lock knob 2 and the operation handle 2S, which is biased by the torsion spring 16 and is temporarily held at the initial rotational position, are coaxially and rotatably connected to the handle base 1. An operating force applied to the operation handle 2S and the lock knob 2 is transmitted to the door lock device 6 of the vehicle via the cable device 5 in which the inner cable 4 is inserted into the outer cable 3.

The cable connection unit 9 connected to the handle base 1 is mounted to the tip end of the outer cable 3 of the cable device 5. The cable connection unit 9 movably holds the handle connection portion 8 of the inner cable 4 inside the single unit case 7.

The cam portion 12 is provided in the cable connection unit 9. The cam portion 12 presses the driven projection portion 10, which projects from the lock knob 2, on an operation path on which the operation handle 2S is connected to the handle connection portion 8, and moves the lock knob 2 to the position at which the lock knob 2 can be connected to the cable device 5.

The cable connection unit 9 can be set for each cable device 5, and if the handle connection portion 8 of the cable device 5 corresponding to the lock knob 2 and the operation handle 2S is held by the single unit case 7, assemblability improves.

In a case where there are multiple operation portions such as the lock knob 2 and the operation handle 2S, the cable connection unit 9 is not necessarily required to correspond to all of the operation portions, and corresponds to a portion (multiple) of the operation portions while taking into consideration the mounting path of the cable connection portion 9 with respect to the handle base 1, the direction of connection of the cable connection unit 9 to the operation portion, and the like, and a single cable connection unit 9 is prepared to correspond to the remaining operation portions 2, or multiple cable connection portions 9 may be also prepared to collectively correspond to the remaining operation portions 2.

The operation handle 2S may be the temporary hold operation portion 2S that is held at a predetermined temporary hold position on the handle base 1 by the biasing force.

The unit case 7 is provided with the cam portion 12 that presses the driven projection portion 10 of the lock knob 2 on an operation path on which the cable device 5 to be connected to the temporary hold operation portion 2S is connected to the temporary hold operation portion 2S, and moves the operation portion 2 to a predetermined connection position.

The operation handle 2S is biased to the initial rotational position by the torsion spring 16, and the position (temporary hold position) of the operation handle 2S relative to the handle base 1 is determined by the biasing force. The cam portion 12 is provided corresponding to the operation handle 2.

The cam portion 12 rotates the lock knob 2 on an operation line along which the handle connection portion 8 of the inner cable 4 is connected to the cable connection portion 11 of the operation handle 2S, and the cam portion 2 moves the cable connection portion 11 of the lock knob 2 on the corresponding movement path of the handle connection portion 8.

In the vehicle handle device of this disclosure, the connection of the cable device is complete by only mounting the cable connection unit to the handle base, and thus, it is possible to improve operability in the connection of the cable device.

DESCRIPTION OF REFERENCE NUMERALS AND SIGNS

1: HANDLE BASE
2: OPERATION PORTION (LOCK KNOB)
2S: TEMPORARY HOLD OPERATION PORTION (OPERATION HANDLE)
3: OUTER CABLE
4: INNER CABLE
5: CABLE DEVICE
6: DOOR LOCK DEVICE
7: UNIT CASE
8: HANDLE CONNECTION PORTION
9: CABLE CONNECTION UNIT
10: DRIVEN PROJECTION PORTION
11: CABLE CONNECTION PORTION
12: CAM PORTION
13: GUIDE
14: CONNECTION MAIN BODY PORTION
15: PIN-SHAPED PROJECTION
16: TORSION SPRING

The invention claimed is:

1. A vehicle handle device comprising:
a handle base;
an operation portion that is rotatably connected to the handle base;
a cable device that includes an outer cable and an inner cable inserted into the outer cable, and transmits an operating force, which is applied to the operation portion, to a door lock device of a vehicle;
a cable connection unit mounted to a tip end of the outer cable;
a unit case that is provided with the cable connection unit, is connectable to the handle base, and movably holds a handle connection portion, which is formed on the inner cable, on a predetermined movement path; and
a cam portion that is provided in the unit case, and, during an operation of mounting the unit case to the handle base, presses a driven projection portion which is provided in the operation portion, to move a cable connection portion of the operation portion to a connecting position with respect to the handle connection portion so as to couple the operation portion to the cable connection unit, providing the connection by which the operating force is transmitted to the door lock device from the operation portion.

2. The vehicle handle device according to claim 1,
wherein the handle base is provided with a guide that restricts a mounting path of the unit case with respect to the handle base during the operation of mounting the unit case to the handle base.

3. The vehicle handle device according to claim 1,
wherein the handle connection portion comprises pin-shaped projections, which project from both ends of a connection main body portion having a circular section, wherein the pin-shaped projections are movably supported, and thus, the handle connection portion is held on the predetermined movement path in a state when the unit case is mounted to the handle base, and wherein the cable connection portion can be locked to the connection main body portion from an outer circumferential direction, a diameter dimension of an innermost portion of the cable connection portion is substantially the same as a diameter dimension of the connection main body portion, and the cable connection portion is formed into a cutout shape in which a width of the cable connection portion is gradually widened toward an open end.

4. A vehicle handle device comprising:

a handle base;

a lock knob that is rotatably connected to the handle base;

an operation handle that is rotatably connected to the handle base and is coaxial with the lock knob, and is biased by a torsion spring so as to be temporarily held in an initial rotational position;

a cable device for the lock knob which transmits an operating force, which is applied to the lock knob, to a door lock device;

a cable device for the operation handle which transmits operating force, which is applied to the operation handle, to the door lock device; and a unit case that includes a cable connection unit and is connected to the handle base, wherein the cable device for the lock knob includes an outer cable and an inner cable inserted into the outer cable, wherein the cable device for the operation handle includes an outer cable and an inner cable inserted into the outer cable, wherein a handle connection portion, which is provided on the inner cable of the cable device for the lock knob, and a handle connection portion, which is provided on the inner cable of the cable device for the operation handle, are movably held inside the unit case, and wherein the cable connection unit is provided with a cam portion that presses a driven projection portion, which projects from the lock knob, during an operation of mounting the unit case to the handle base so as to move the lock knob to a position in which the lock knob is connected to the cable device for the lock knob.

5. The vehicle handle device according to claim 4, wherein a biasing force of the torsion spring temporarily holds the operation handle in a predetermined temporary hold position relative to the handle base.

* * * * *